United States Patent [19]

Sterner

[11] 4,327,533

[45] May 4, 1982

[54] CRANE BOOM EXTENDING, RETRACTING AND COOPERATIVE LATCHING ARRANGEMENT

[75] Inventor: Russell L. Sterner, Greencastle, Pa.

[73] Assignee: Kidde, Inc., Clifton, N.J.

[21] Appl. No.: 177,789

[22] Filed: Aug. 13, 1980

[51] Int. Cl.[3] ..... B66C 23/04

[52] U.S. Cl. ..... 52/115; 52/118; 52/632; 212/267; 212/268

[58] Field of Search ..... 52/115, 118, 632; 212/202, 203, 264, 267, 268, 269, 230, 231

[56] References Cited

U.S. PATENT DOCUMENTS

| | | | |
|---|---|---|---|
| 3,361,456 | 1/1968 | Durand | 52/115 X |
| 3,398,492 | 8/1968 | Nansel | 52/115 |
| 3,631,988 | 1/1972 | Noly | 212/231 |
| 3,670,465 | 6/1972 | Cheze | 52/115 |
| 3,738,075 | 6/1973 | Nansel | 52/115 |
| 3,770,138 | 11/1973 | Chalupsky | 52/115 X |
| 3,842,985 | 10/1974 | Swede | 212/264 |
| 4,036,372 | 7/1977 | Rao et al. | 212/230 |

*Primary Examiner*—Robert G. Sheridan
*Attorney, Agent, or Firm*—Brady, O'Boyle & Gates

[57] ABSTRACT

To reduce the weight and increase the lifting capacity of a multi-section telescopic crane boom, a single hydraulic cylinder for the full extension and retraction of individual boom sections is anchored in the relatively stationary boom base section. A sled structure surrounding the single cylinder and moving therewith has guided engagement through plates fixed to the movable boom sections at or near their rear ends. Driving finger mechanisms on opposite sides of the sled are biased toward driving engagement with the plates of the movable boom sections and are retractable into chambers of the sled. A cooperative locking pin operating assembly for the movable boom sections is fixed on the forward end of the boom base section and includes power retracting devices which operate mating retracting cranks and locking pin sets individual to the movable boom sections when the retracting cranks are aligned beneath the power retracting devices. The movable boom sections are equipped near their outer and inner ends with locking receivers for said locking pins.

18 Claims, 19 Drawing Figures

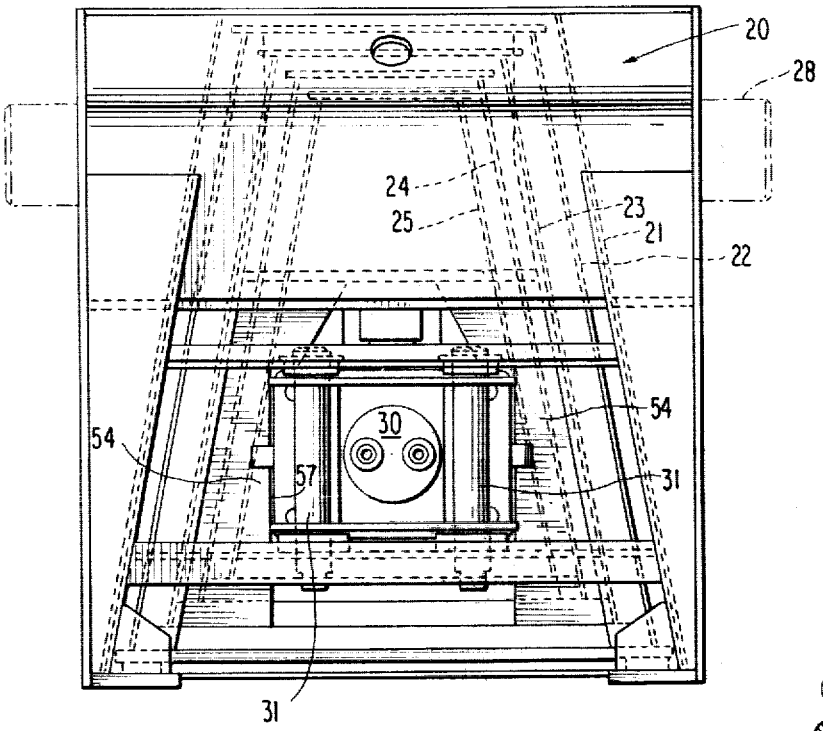
FIG. 3
FIG. 5
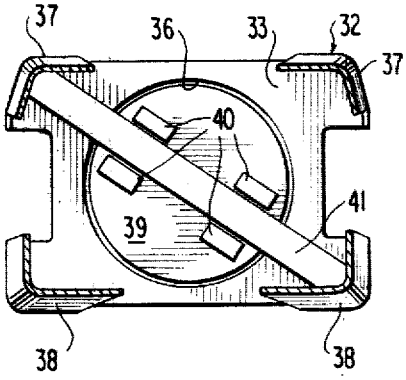
FIG. 4
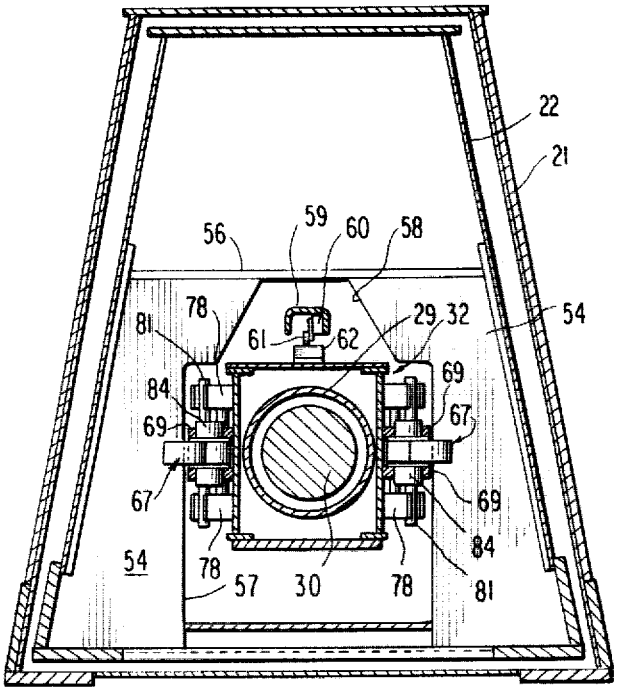
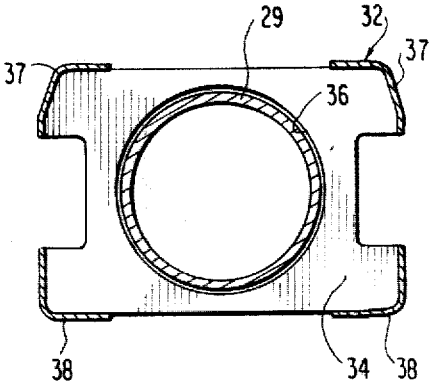
FIG. 6

FIG. 7
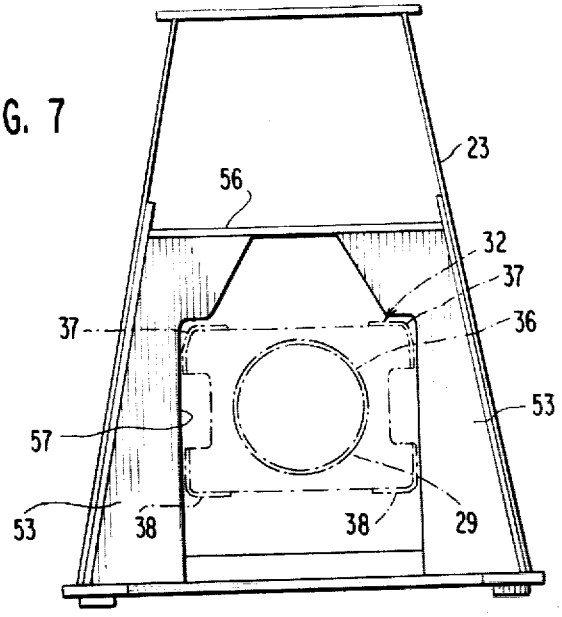
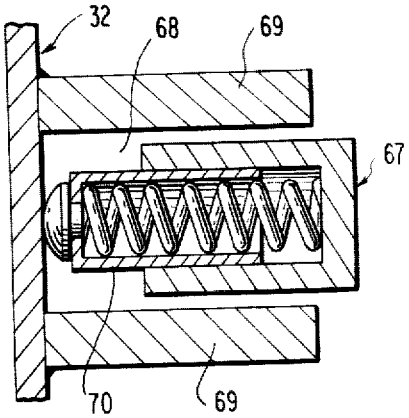
FIG. 13
FIG. 8
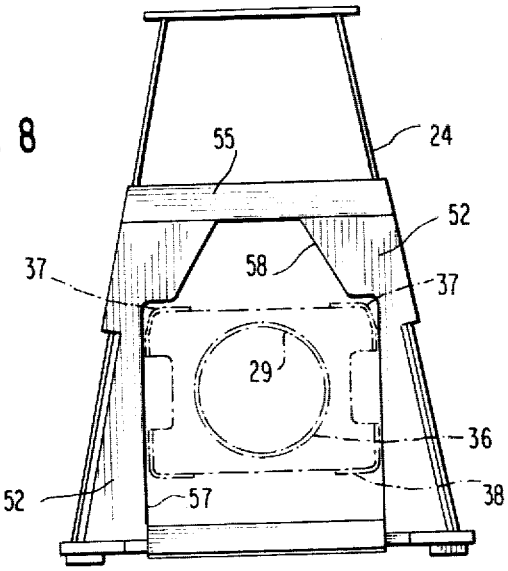
FIG. 9
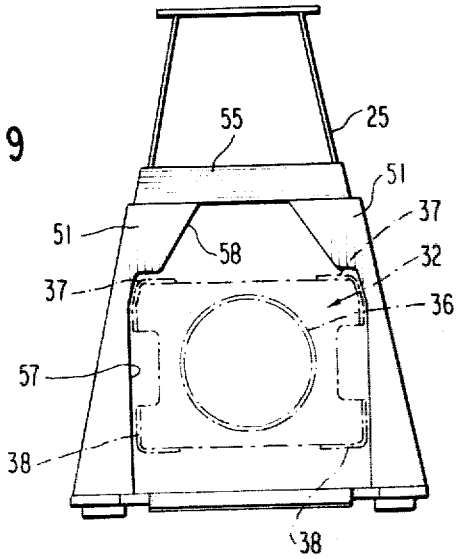

12a
30
85
86
84
67
82
81
83
78
77
80
69
76
75
68
37
38
32
29

22
23
24
25
29
32
38
51
52
53
54
67
68
69
70
71
72
73
74
81
82
83
84
85
86
13

90
112
113
87
107
114
113
109
111
110
115
116
16
49
122
121
125
123
17
124
118
120
88
96
117
119
25

114
120
121
88
126
119
117
123
124
118
125
96
122
120

114
122
117
96
118
17
115
119
88
123
126
125
96

CRANE BOOM EXTENDING, RETRACTING AND COOPERATIVE LATCHING ARRANGEMENT

BACKGROUND OF THE INVENTION

The ever-increasing demand for hydraulically operated telescoping crane becomes of greater load lifting capacity and the resulting increases in size of the telescoping booms has created a need for a less massive mechanism for extending and retracting the telescoping boom. In smaller conventional hydraulically operated telescoping booms, the hydraulic cylinders used to extend and retract the movable boom sections are loaded within the base section and within all of the outward moving boom sections except the fly section of the boom, in some cases. As the boom increases in size and in its number of telescoping sections, the weight of this hydraulic cylinder mechanism becomes intolerable and in its conventional form tends to defeat the purpose of increasing the boom size. It is the objective of this invention to deal effectively with this problem, and more particularly to provide a lighter weight extending and retracting cylinder arrangement in the form of a single cylinder whose weight can be concentrated within the base section of the crane boom.

It is a further feature and objective of the invention to provide on the boom base section in concert with the single boom extending and retracting cylinder thereof a latching assembly including independently operable individual spring activated and power retracted latching or locking pins for each movable boom section, so that each such section can be positively and safely locked in the fully extended or fully retracted position relative to the next innermost section of the boom.

A still further object of the invention is to provide a more reliable and more positive extending and retracting mechanism for each individual boom section in proper sequence. This mechanism involves opposite side intermeshing fingers, each pair of which in the extended or active position under spring loading defines a recess for capturing an extending and retracting rigid plate on each individual boom section. The spring-urged fingers are retracted by associated power means to enable the free passage thereover of movable boom sections whose extending and retracting plates do not require capturing in the creation of a particular desired boom configuration.

Another important aspect of the invention resides in a precision guidance system on the movable boom sections at the rearward ends thereof for a sled structure which closely surrounds the single boom extending and retracting cylinder whose rod end is anchored in the base section at the rearward end thereof. The sled structure is equipped with wear pads including inclined pads at its fore and aft ends which can pass over cooperative stepped lands at the rear ends of the movable boom sections during extension or retraction thereof by operation of the single cylinder.

In general, the present invention is characterized by compactness of construction, efficiency and reliability of operation, maximum safety in operation, and overall practicality from a manufacturing standpoint. Various additional features and advantages will be apparent to those skilled in the art during the course of the following detailed description.

BRIEF DESCRIPTION OF THE DRAWINGS

FIG. 3 is a rear end elevational view of the boom.

FIG. 4 is a transverse vertical section taken on line 4—4 of FIG. 2 showing the boom base and inner mid-sections.

FIG. 5 is an enlarged transverse vertical section taken on line 5—5 of FIG. 2.

FIG. 6 is a similar section taken on line 6—6 of FIG. 2.

FIGS. 7, 8 and 9 are views similar to FIG. 4 showing the rearward ends of the boom center mid-section, outer mid-section and fly section, respectively.

FIG. 13 is an enlarged cross section taken on line 13—13 of FIG. 12*b*.

DETAILED DESCRIPTION

Figure 1:
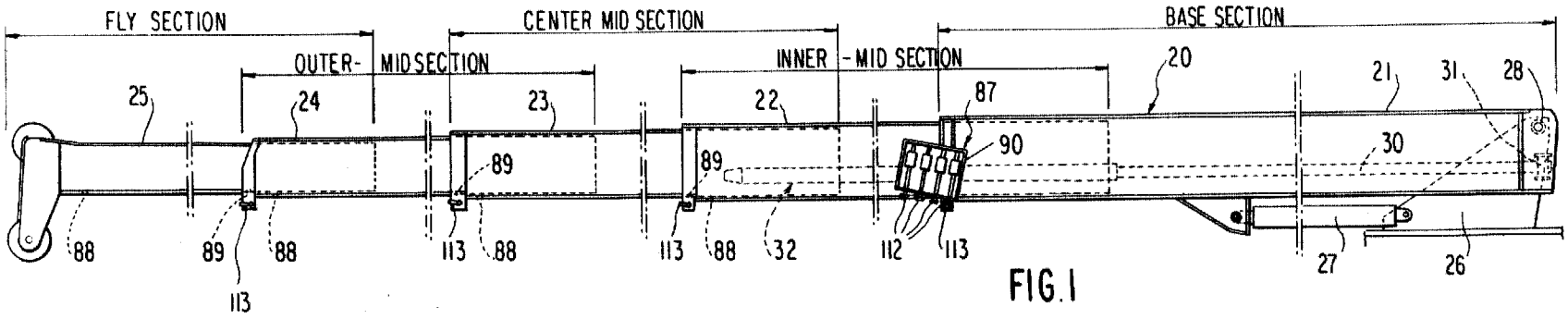
FIG. 1 is a side elevation of a crane boom embodying the present invention.

Referring to the drawings in detail, wherein like numerals designate like parts, a multi-section telescopic crane boom 20, such as a five section boom, includes a base section 21, inner mid-section 22, center mid-section 23, outer mid-section 24, and a fly section 25. The illustrated boom has a trapezoidal cross section for the greatest possible strength. The boom 20 is mounted on a turntable support structure 26 of a suitable crane carrier, not shown, and has raising and lowering power cylinder means 27 connected between the support structure 26 and the lower side of base section 21. The boom pivot 28 is located at the top of the support structure 26 and near the upper rear corner of the base section 21.

Figure 2:
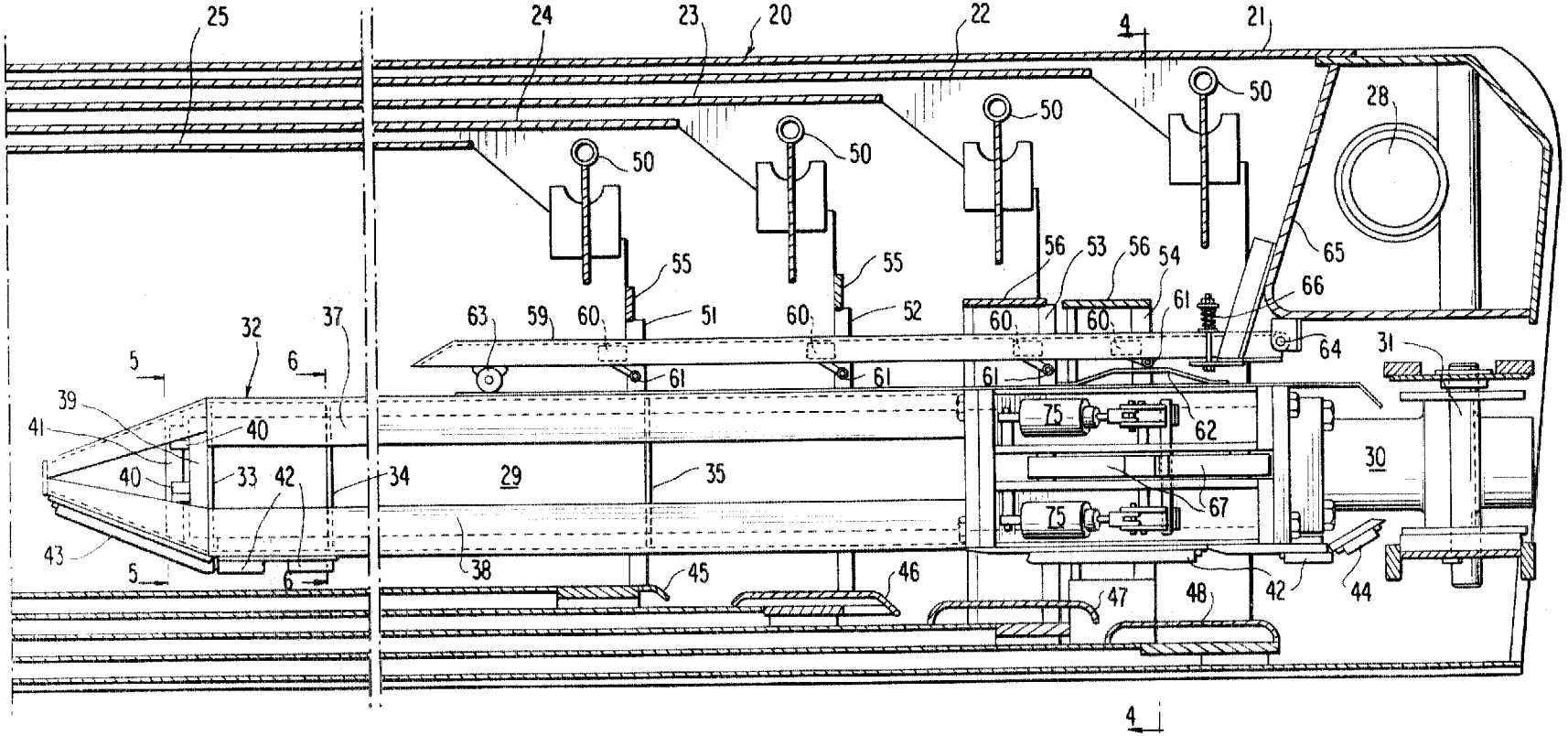
FIG. 2 is an enlarged fragmentary side elevation, partly in cross section showing the boom of FIG. 1 in a retracted state.

In accordance with the invention, the telescopic boom 20 is extended and retracted by a single large hydraulic cylinder 29 within the interior of the base section 21 when the boom is fully retracted, as shown in FIG. 2. The rod 30 of this cylinder 29 is securely anchored to the rear end of base section 21 by the anchoring structure shown at 31 in FIGS. 1 and 2.

The cylinder 29 proper is disposed within a sled structure 32 and supported thereby for movement therewith longitudinally of the boom. As shown in FIGS. 5 through 9, the sled structure 32 comprises a series of vertical plates 33, 34, 35, etc. in longitudinally spaced relationship along the sled structure, each plate having a bore 36 closely surrounding the large cylinder 29. The several plates 33, 34, 35, etc. are rigidly interconnected as a unit by top and bottom corner members 37 and 38 of the sled 32. The sled 32 thus forms a cradle support for the cylinder 29 which travels therewith whenever a section of the boom is extended or retracted by operation of the cylinder, as will be further described. A forward end cap plate 39 of the cylinder 29 carries pairs of spaced fixed lugs 40 between which extend a diagonal keying bar 41 having its opposite ends welded to a pair of the corner members 37 and 38 on the sled 32. The opposite end of the sled is bolted to the rod end of the cylinder 29. This arrangement locks the cylinder 29 against rotation and also prevents the cylinder body from moving forwardly longitudinally relative to the sled.

The sled 32 is equipped with bottom wear pads 42 and forward and rear end inclined wear pads 43 and 44. The bottom wear pads 42 normally slide on the bottom walls of the respective boom sections 21, 22, 23, etc. during extension and retraction of a particular boom section. The inclined wear pads 43 and 44 enable the sled to slide over rear end ramps 45, 46, 47 and 48 of the boom sections which are at slightly different elevations. FIG. 2 showing the arrangement of the wear pads omits the normal bending of the cylinder and rod along its length, and FIG. 1 also omits this and the normal bending and cocking of the boom sections which increases as the length of the boom increases. This omission is for the sake of simplicity of illustration. Therefore, in actuality, the wear pads 42 are in sliding contact with the bottom walls of the several boom sections during extension and retraction operations. The several boom sections themselves have lower wear pads 49 and mountings 50 for upper wear pads, not shown. The boom sections also have lower wear pads, not shown, in the areas of the ramps 45, 46, 47 and 48 that engage the bottom corner members 38 at various times to support the sled.

At the rear end of each boom section, with the exception of the base section 21, there is provided a rigid vertical plate 51, 52, 53 and 54. These several plates form important elements in the full extension and full retraction of the individual boom sections 22 . . . 25 selectively by the cylinder 29. As shown in FIGS. 4 and 7 through 9, the vertical plates 51 . . . 54 have top reinforcing members 55 and 56 rigid therewith, and the vertical plates define aligned sled guidance openings 57 which are of the same width on each telescoping boom section so that the moving sled and cylinder wil be properly guided. The generally rectangular openings 57 also have top guidance edges and top tapered extensions 58 to accommodate a relatively stationary longitudinal channel member 59 serving to mount a series of limit switches 60 corresponding in number to the movable boom sections 22 . . . 25. During movement of the cylinder 29 and sled 32, the actuators 61 of these switches are successively engaged by a raised cam 62 on the top of sled 32 near its rear end. The switches 60 operate indicator means, not shown, such as lights, to signal the approach of engagement of fingers, yet to be described, on the sled 32 with the respective extending and retracting plates 51 . . . 54 of the movable boom sections, and indicate the location of the sled at all times. The forward end of channel member 59 is equipped with a wheel 63 rollingly engaging a top plate on the sled 32. The rear end of the channel member 59 is pivotally suspended at 64 from a torque box 65 surrounding the boom pivot 28 and is biased downwardly on the sled 32 by a spring means 66.

Figures 12A, 12B:
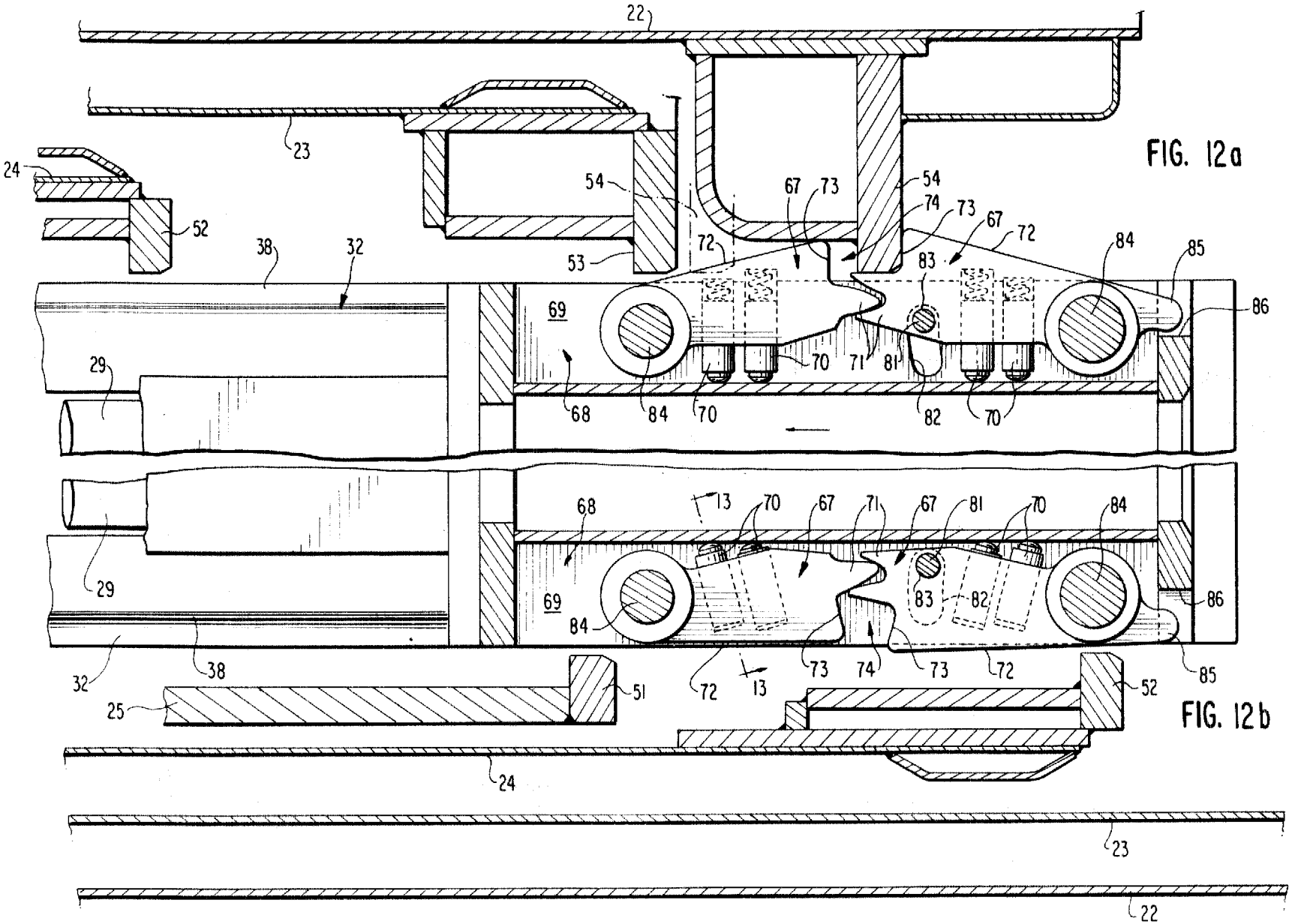
FIG. 12*a* is a fragmentary horizontal section taken on line 12*1*—12*a* of FIG. 10, and corresponding to FIG. 11*a*.
FIG. 12*b* is a similar section corresponding to FIG. 11*b*.

On opposite sides of the sled 32 near its rear end are pairs of fingers 67 which coact with the vertical plates 51 . . . 54 in the selective full extension or full retraction of the individual movable boom sections by the single cylinder 29. As best shown in FIGS. 12*a* and 12*b*, the pairs of fingers are contained within side recesses 68 of the sled 32 formed by vertically spaced plates 69. The pairs of fingers are biased outwardly toward driving engagement with the plates 51 . . . 54 by spring units 70 as shown in FIGS. 12*a*, 12*b* and 13. Each coacting pair of fingers 67 have intermeshing teeth 71 to assure their operation in unison. The fingers have exterior inclined faces 72 and lateral shoulders 73 across the axis of cylinder 29, which shoulders define between them a recess 74 for capturing selectively plates 51 . . . 54 of the several movable boom sections.

The pairs of fingers 67 at requied times are retracted into the recesses 68 and away from the plates 51 through 54 by coordinated pairs of pneumatic cylinders 75 on opposite sides of the sled 32. The rods 76 of these paired pneumatic cylinders are pivotally coupled as at 77 with operators 78 having slots 79. The operators 78 are pivotally anchored by shafts 80 on the sled structure 32 and their slots 79 receive pins or shafts 81 which pass through clearance slots 82 in the fixed plates 69 of the sled structure. Pins or shafts 81 are received through a drive opening 83 in one finger 67 of each intermeshing toothed pair, FIGS. 12*a* and 12*b*. The individual fingers 67 of each pair are pivotally attached through pins 85 to the plates 69 of the sled structure 32.

The arrangement of the paired driving fingers 67 for the extension and retraction of the movable boom sections is a fail-safe arrangement in that the fingers are always biased outwardly toward interlocking driving engagement with the plates 51 . . . 54 by the spring units 70. They are restricted by the pneumatic cylinders 75 and even if these cylinders were to fail, the fingers would prevent collapsing of the extended, or partly extended, boom. Outward movement of the fingers 67 is positively limited by contact of a lug 85 on one finger of each pair with a surface 86 on the sled structure.

Another major aspect of the invention is the provision on the boom base section 21 of a locking pin assembly 87 for the individual movable boom sections 22 . . . 25 in their fully retracted and fully extended positions. It is emphasized that the assembly 87 is bodily mounted on the forward end of stationary base section 21 of the boom and does not travel with any of the movable boom sections. The details of the assembly 87 are shown in FIGS. 1 and 14 to 17.

To cooperate with the locking pins that are operated by the locking pin assembly 87, now to be described, it must be understood that each movable boom section 22 . . . 25 is provided in its bottom wall with pairs of locking pin openings 88 and 89. The openings 88 are close to the front end of each boom section and the openings 89 are near and forwardly of the rear end of the boom section, in the socketing portion of the boom section. These openings 88 and 89 are shown schematically in FIG. 1.

Figure 14:
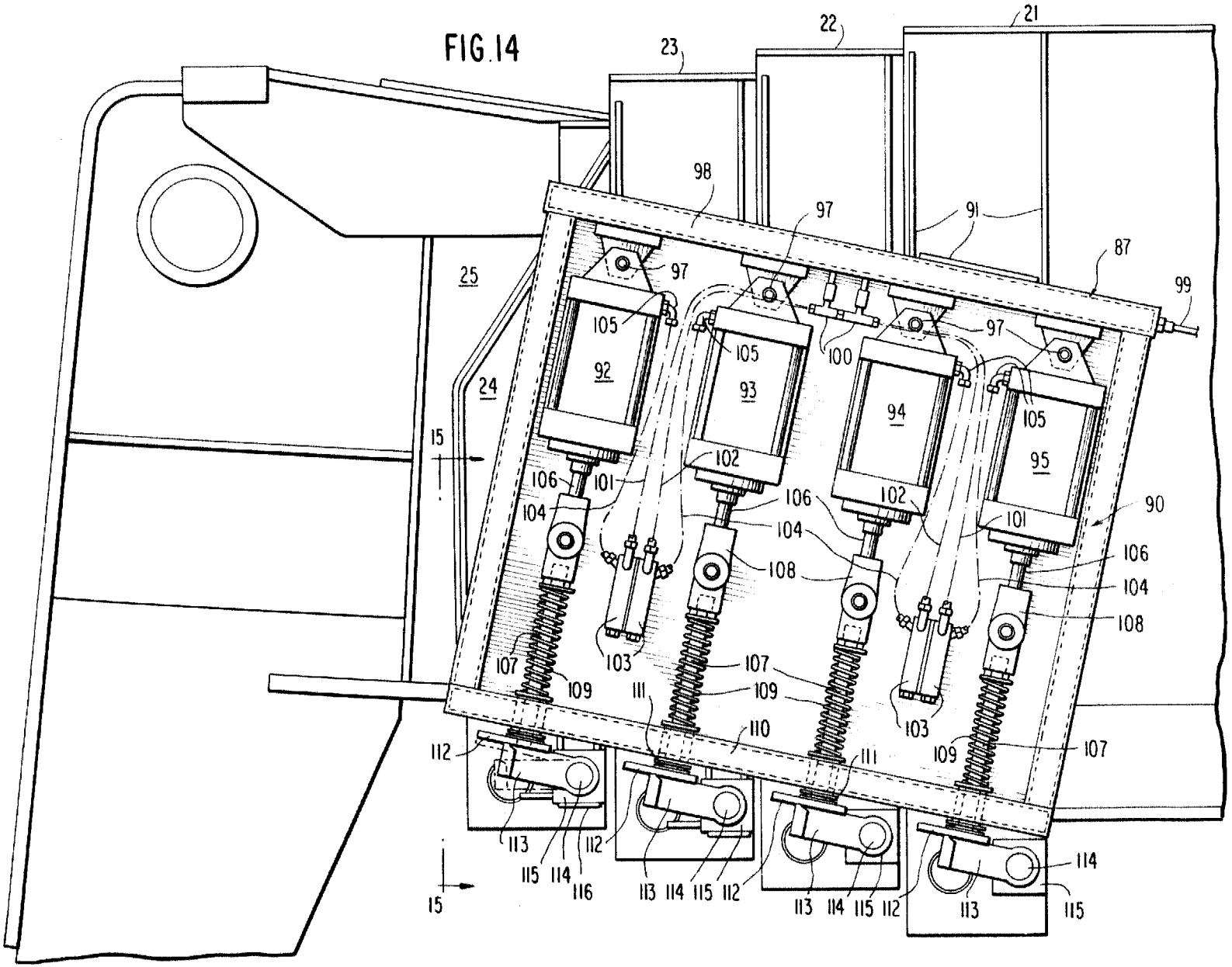
FIG. 14 is an enlarged fragmentary side elevation of a boom latching pin assembly and power retracting means on the boom base section, the other boom sections being shown retracted.
Figure 15:
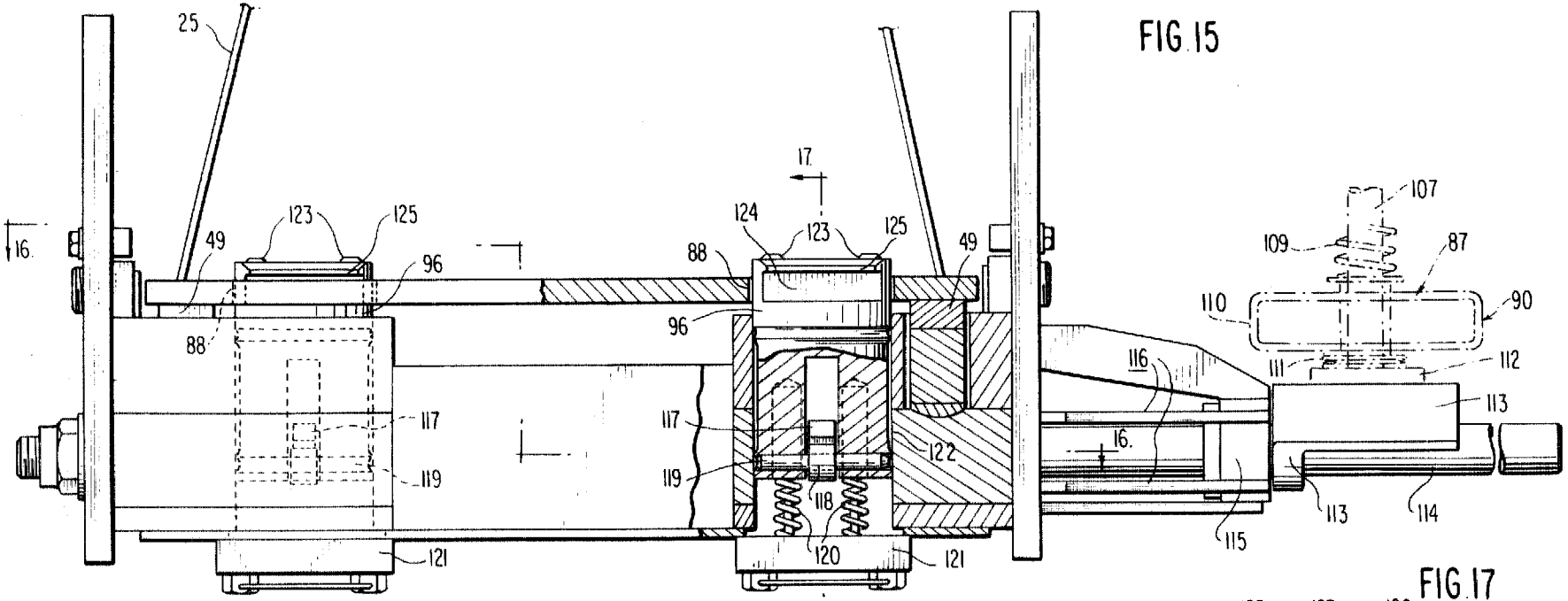
FIG. 15 is a fragmentary vertical section taken on line 15—15 of FIG. 14.
Figure 17:
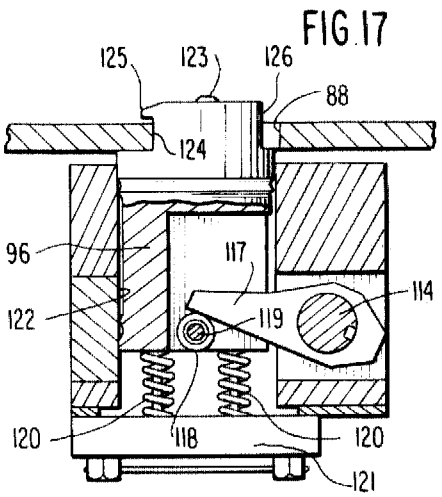
FIG. 17 is a fragmentary vertical section taken on line 17—17 of FIG. 15.

Referring to FIGS. 14 through 17 primarily, the locking pin assembly 87 comprises a vertically disposed rectangular frame 90 having its upper and lower members inclined relative to the boom longitudinal axis, FIG. 14, to compensate for the difference in cross sectional size of the several movable sections of the boom. The frame 90 is rigidly supported in a vertical plane on the base section 21 by suitable supporting and bracing structure 91, the details of which are not completely shown and which may be varied, and are not important to a full understanding of the invention.

Supported on the frame 90 in side-by-side parallel inclined axis array are pneumatic cylinders 92, 93, 94 and 95 corresponding in number to movable boom sections 22 . . . 25 and operable to cause retraction of spring-loaded fail-safe locking pin pairs 96. The tops of cylinders 92 . . . 95 are pin coupled at 97 to the top frame member 98 which is hollow and serves as a compressed air manifold, receiving air from an inlet line 99, FIG. 14. Such compressed air is delivered from the manifold 98 to the pneumatic cylinders 92 . . . 95 through paired T-fittings 100 into flexible lines 101 nd 102 which deliver the compressed air to pairs of solenoid valves 103 having air outlet lines 104 leading to inlet fittings 105 on the pneumatic cylinders, behind the pistons of the cylinders. The solenoid valves 103 enable the selective independent operation of any individual pneumatic cylinder 92 . . . 95 to cause retraction of the locking pins 96 from the locking openings 88 or 89 of any particular movable section of the boom which must be released for full extension or full retraction by the hydraulic cylinder 29 in order to create the desired crane boom configuration.

The rods 106 of the several pneumatic cylinders are coupled to plungers 107 through couplings 108. The rods 106 and plungers 107 are biased by springs 109 to retracted positions relative to the cylinders 92 . . . 95 but the rods 106 are extended by the cylinders against the springs 109 when the locking pins 96 require retraction from the locking openings 88 and 89 of the movable boom sections. The plungers 107 have guided engagement through openings in the lower frame member 110.

The lower ends of plungers 107 carry shoes 112 and retain shock-absorbing belleville springs 111 between them and the lower surface of lower frame member 110. Plunger shoes 112 bear upon the upper shoes of inclined rotatable crank levers 113 secured to transverse horizontal rocker shafts 114 at stepped elevations, FIG. 14, on the respective boom sections 21 . . . 24 in the retracted positions. The rocker shafts 114 are held in bearings 115, in turn secured by gusset plates 116 to the front reinforcement collar of the respective boom section. The rocker shaft 114 and crank lever 113 on the front of the outer mid-section 24, center mid-section 23, and inner mid-section 22 move outwardly with these sections from beneath the shoes 112 and locking pin assembly 87, when these sections are extended, FIG. 1.

At spaced locations thereon, each rocker shaft 114 carries keyed locking pin retractor arms 117 which cammingly engage retractor rollers 118 of the locking pins 96 carried by cross pins 119 in the latter. The locking pins 96 are biased upwardly toward fail-safe locking positions with the bottom walls of boom sections 22 . . . 25 by biasing springs 120 which bottom on plates 121 secured to the bottoms of the reinforcement collars of the boom sections. As clearly shown in FIG. 1, the locking pin openings 88 and 89 of the movable boom sections are rectangular, whereas the locking pins 96 are cylindrically formed and are mounted for reciprocation within cylindrical bores 122, in the front of each boom section 21 . . . 24.

Figure 16:
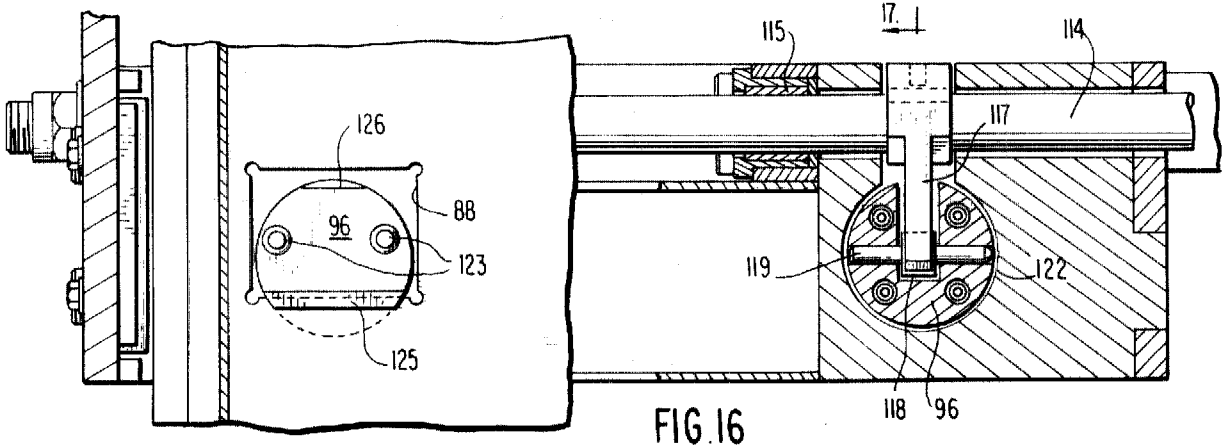
FIG. 16 is a staggered horizontal section taken on line 16—16 of FIG. 15.

The tops of locking pins 96 carry aluminum-bronze bearing pins 123 to minimize wear due to sliding engagement of the movable boom sections on the spring-biased locking pins. The top portions of the locking pins have forward notches 124 forming top forward lips 125 which can overlap the forward edge of the rectangular opening 88 or 89 for safety, as shown in FIG. 16. The rear side of each locking pin 96 has a flat face 126. This structure enables the tops of the pins to protrude through the rectangular openings.

Each pair of booms section locking pins 96 associated with one of the rocker shafts 114 is retracted in unison by the arms 117 of such shaft to release a particular boom section from its fully retracted or fully extended position, as required in a particular situation. Each pair of locking pins 96 associated with each rocker shaft is spring-biased toward locking engagement in the openings 88 or 89 of the movable boom sections, as previously stated. Each pair of locking pins 96 associated with one shaft 114 is retracted against the biasing springs 120 and also against the springs 109 by the power extension of one of the cylinder rods 106 for the particular pneumatic cylinder 92 . . . 95 which corresponds to one of the movable boom sections 22 . . . 25. In this connection, the cylinder 92 retracts the locking pins 96 on the outer mid-section 24 for the boom fly section 25 shown in FIG. 15. The cylinder 93 retracts the locking pins 96 on the center mid-section 23 for the boom outer mid-section 24. The cylinder 94 retracts the locking pins on the inner mid-section 22 for the center mid-section 23, and the cylinder 95 retracts the locking pins on the base section 21 for the inner mid-section 22.

OPERATION

The laterally spaced pairs of spring-urged locking pins 96 due to their stepped arrangement, FIG. 14, will lock every movable boom section 22 . . . 25 securely in the fully retracted or fully extended position relative to the next innermost boom section due to engagement in the locking openinngs 89 or 88 of the movable boom sections. When any given boom section is retracted, its locking pins 96 enter the openings 88 of that boom section and when the same boom section is extended, its locking pins enter the openings 89. All of the pneumatic cylinders 92 . . . 95 for retracting the locking pins 96 remain with the assembly 87 on the base section 21 of the crane boom, while the locking pins 96 and the associated rocker shaft 114 and operating crank lever 113 of the outer mid-section 24, center mid-section 23 and inner mid-section 22 remain with and travel with these sections, while these elements of the base section remain with the base section beneath the assembly 87.

In the operation of the boom, varying configurations can be created by use of the single extending and retracting hydraulic cylinder 29 and the associated fingers 67 which drive selected boom sections outwardly or inwardly to the full extents of their travel where they are individually securely locked by the pins 96.

If a short but very rigid boom is required, for example, only the inner mid-section 22 will be extended from the fully retracted and locked position in the base section 21 to the fully extended and locked position. In such case, the movable sections 23, 24 and 25 forwardly of the inner mid-section 22 will remain fully telescoped within the inner mid-section and locked by engagement of the pairs of pins 96 in the openings 88 of these boom sections.

If a boom of maximum length is required, all of the movable boom sections can be fully extended and locked by the pins 96 one at a time, starting with the full extension of the fly section 25 and followed by the extension of the outer mid-section 24, and then the center mid-section 23, and finally the extension of the inner mid-section 22. The safe pin locking of the extended boom section or sections will be automatic due to the entry of the locking pins 96 into the openings 89 under influence of the strong biasing springs 120.

In forming any required boom configuration, the forwardmost boom section which it is desired to extend must be extended first by operation of the cylinder 29, followed by extension of one or more rearward boom sections in succession by further operations of the hydraulic cylinder 29. Similarly, when the crane boom is to be retracted or collapsed, the rearmost movable boom section, previously extended from the base section, is first retracted by operation of the cylinder 29, followed by the retraction of successively outermost boom sections which have been previously extended.

Before any movable boom section can be extended or retracted, the locking pins 96 for that particular boom section must first be retracted by one of the cylinders 92 . . . 95. Each such pneumatic cylinder is under control of one of the solenoid valves 103, which in turn is controlled by an operator switch, not shown in the drawings.

Similarly, before any movable boom section can be fully extended or fully retracted by operation of the hydraulic cylinder 29, its particular driving plate 51, 52, 53 or 54 must enter the driving recess 74 formed by each pair of driving fingers 67 at each side of the sled 32, such driving fingers being biased outwardly from the sled at all times by the spring units 70, unless retracted by the pneumatic cylinders 75.

As the sled 32 is driven forwardly or rearwardly by the single hydraulic cylinder 29, the pairs of fingers 67 will move with it and will automatically capture in the recesses 74 the vertical edges of the plate 51, 52, 53 or 54 requiring advancement or retraction. Pressure of such driving plate upon the shoulders 73 of fingers 67, FIG. 12*a*, will only cause the fingers to engage the plate more securely, because these shoulders are eccentrically located from the axes of pivot elements 84. This is another safety feature of the invention.

Driving engagement of the spring-urged fingers 67 with the plates 51 . . . 54 takes place automatically as the interior side edges of the plates cammingly engage the inclined finger surfaces 72 during extension or retraction of a particular boom section. Retraction of the driving fingers 67 from the respective plates 51 . . . 54 requires operation of the pneumatic paired cylinders 75 to the position shown in FIG. 11*b* to produce finger retraction as shown in FIG. 12*b*.

Finally, to extend any retracted boom section, the biased locking pins 96 for that particular section must first be power retracted from the leading locking openings 88 by operation of the correct pneumatic cylinder 92 . . . 95 for that particular boom section, as previously explained. After such locking pin retraction, the correct pneumatic cylinder 92 . . . 95 remains energized, the cylinder 29 already engaged with the selected section is extended to cause complete extension of the selected movable boom section 22 . . . 25. As the chosen boom section approaches full extension, the corresponding pneumatic cylinder 92 . . . 95 is de-energized and the crank lever 113 moves upwardly and the bearing pins or pads 123 on the locking pins 96 move into sliding contact with the bottom plate for that boom section somewhat in advance of the opening 89 and as the cylinder 29 continues to advance the boom section the pins 96 will automatically enter the locking openings 89 for that boom section, as previously described. The driving fingers 67 are then retracted, FIGS. 11*b* and 12*b*, and cylinder 29 is retracted to a position where the fingers 67 can engage the next boom section to be extended.

Conversely, to fully retract any chosen boom section by operation of the cylinder 29, after the driving fingers 67 are in engagement with the chosen boom section, the locking pins 96 for that boom section are retracted from the openings 89 by operation of one of the cylinders 92 . . . 95 pushing down on the associated crank lever 113. Following full retraction of the locking pins 96, the selected cylinder 92 . . . 95 remains energized. Cylinder 29 is then retracted. As the chosen boom section approaches full retraction, the selected cylinder 92 . . . 95 is de-energized allowing the crank lever 113 to move upwardly and the bearing pads 123 on the locking pins 96 to move upwardly into sliding contact with the bottom plate of the boom section being retracted while it is still moving at a point somewhat rearwardly of the openings 88. The pins 96 will slide along the bottom of the boom section and will automatically enter the openings 88 to lock the boom section in the retracted position.

In the full extension or full retraction of any given movable boom section prior to locking pin retraction, the biased driving fingers 67 will automatically engage the proper plate 51 . . . 54 of the chosen boom section to safely drive it outwardly or inwardly following locking pin retraction, as previously described, it being understood that the cylinders 75 are operated at proper times to retract the fingers 67 so that they may pass with the sled 32 to the proper location for automatic engagement with the chosen plate 51 . . . 54.

Figures 10, 11A, 11B:
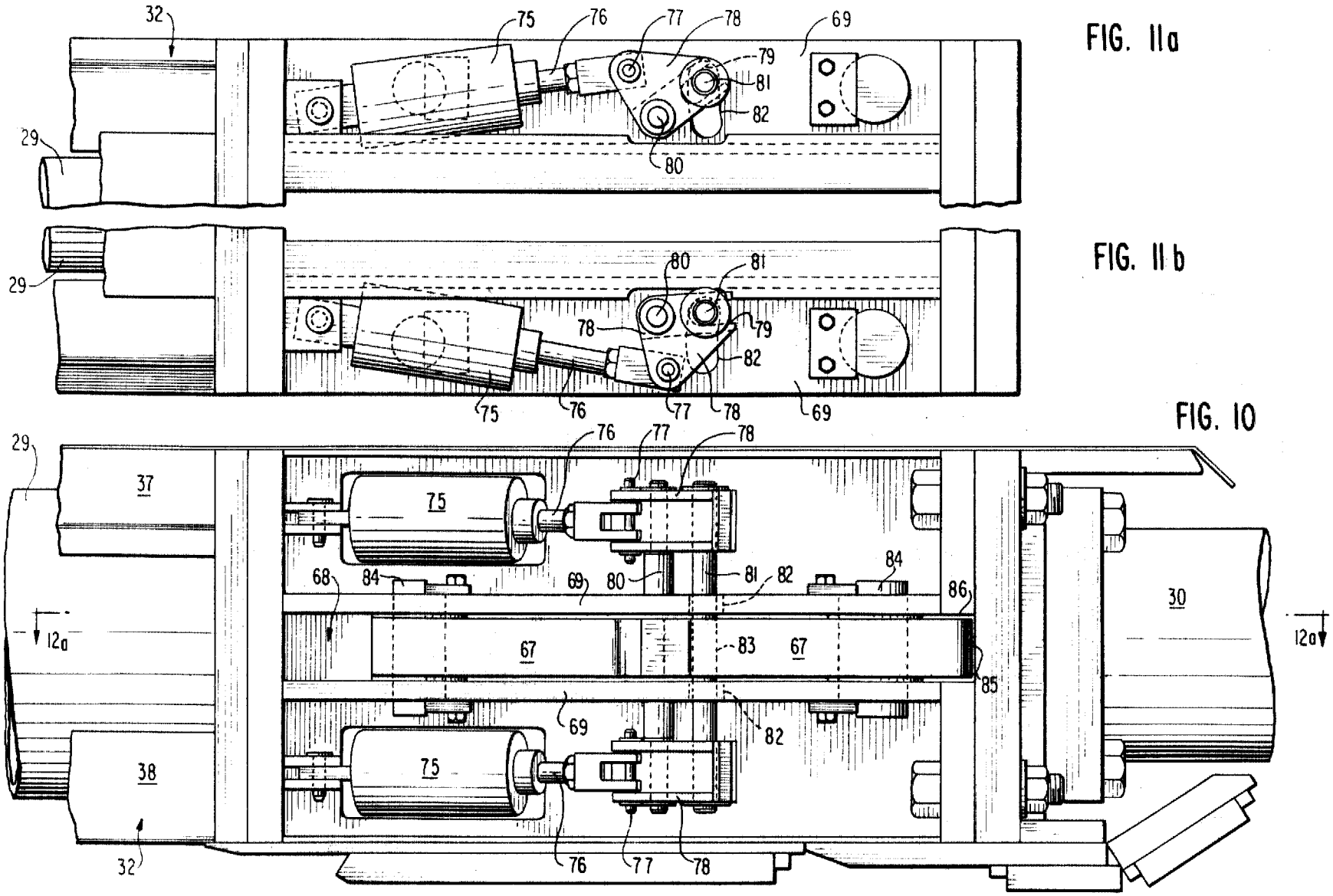
FIG. 10 is an enlarged fragmentary side elevational view of a boom extension and retraction cylinder, associated sled and finger means.
FIG. 11*a* is a fragmentary plan view of finger retraction means on one side of the sled in the non-retract position.
FIG. 11*b* is a similar view of finger retraction means at the opposite side of the sled in a retracting position.

As the retracted driving fingers 67 on the sled 32 approach the chosen plate 51 . . . 54, as indicated by the limit switches 60, the cylinders 75 are de-energized, FIG. 11*a*, and the fingers 67 are extended just rearwardly of the chosen plate 51 . . . 54. Further extension of the cylinder 29 and sled 32 causes the edges of the opening 57 of the chosen plate to engage the inclined finger surfaces 72, as previously explained, and cam the fingers 67 inwardly against the spring units 70 until the edges of the chosen plate reach the driving recesses 74 at which time the driving fingers 67 spring outwardly again to the extended position under the action of spring units 70 on opposite sides of the chosen plate.

It can be seen that the invention enables the construction and use of much larger telescopic crane booms having a higher load lifting capacity, and being comparatively much lighter in total weight than any comparable boom having conventional hydraulic cylinders therein. The great reduction in weight is effected by the use of the single hydraulic cylinder 29 to extend selectively each movable boom section and to retract the same. The arrangement of the sled 32 and driving fingers 67 with retracting means and the cooperative arrangement of the locking pins 96 with selective retracting means enables the attainment of the main objective of the invention, namely, the provision of a larger and comparatively lighter weight boom with greater lifting capacity.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A crane boom comprising plural telescoping boom sections which are individually movable relatively and a boom base section which is relatively stationary and in which all of the movable boom sections may be nested telescopically, each movable boom section having locking detent means thereon near its outer and inner ends, a single power cylinder anchored within the boom base section and being extensible and retractable longitudinally of the boom to fully extend and fully retract selectively any individual movable boom section, each movable boom section having a fixed driving member near its rear end, cooperative driving means for said fixed driving members on said cylinder and moving therewith and being biased toward engagement with the fixed driving members, power means moving with said cylinder to retract said cooperative driving means from said fixed driving members to enable the driving means to pass by certain fixed driving members, a locking assembly common to the movable boom sections and being fixed to the boom base section, plural independently operable locking elements individual to the movable boom sections on certain of the movable boom sections and moving therewith and being biased toward engagement with said locking detent means of adjacent movable boom sections, and plural selectively operable power means on said locking assembly to retract said locking elements of any movable boom section from the locking detent means of an adjacent boom section so that the latter may be fully extended or retracted by said single power cylinder.

2. A crane boom as defined in claim 1, and said fixed driving member of each movable boom section comprising a plate near the rear end of such section having a guide opening therethrough, said cooperative driving means on said cylinder and moving therewith comprising a sled structure secured to the cylinder and adapted for sliding engagement on bottom walls of said movable boom sections, said sled structure having guided engagement within said guide opening of said plate of each boom section, and an extendable and retractable positive driving device for said plate of each boom section selectively on at least one side of the sled structure, spring means biasing said driving device toward engagement with said plate, and power means on said sled structure connected with the driving device to retract it against the spring means so that the driving device may clear plates of non-selected movable boom sections when a particular chosen boom section is undergoing full extension or full retraction.

3. A crane boom as defined in claim 2, and said driving device comprising a pair of intermeshing drive fingers pivotally attached to the sled structure and defining in their biased positions a driving recess which captures an edge of said plate of a selected movable boom section.

4. A crane boom as defined in claim 3, and said fingers having outer side edges inclined to the axis of said boom and cammingly engaging said edge of said plate to depress said fingers against said spring means whereby the edge of said plate may snap into said driving recess.

5. A crane boom as defined in claim 4, and said fingers having pivots on said sled structure offset from the side walls of said driving recess whereby pressure of said plate on said side walls tends to force said fingers further into driving engagement with said plate.

6. A crane boom as defined in claim 5, and overtravel limiting means for said fingers in their biased direction.

7. A crane boom as defined in claim 1, and said locking detent means comprising openings in the bottom wall of each movable boom section, and said locking elements on certain of the movable boom sections comprising locking pins adapted to enter said openings when moved into registration therewith.

8. In a crane boom, a relatively stationary boom base section and a plurality of relatively movable boom sections which are telescopically nestable in the base section when retracted and extendable therefrom, means to fully extend and fully retract each movable boom section selectively to produce desired boom configurations, a locking mechanism common to all of the movable boom sections fixed on the boom base section near its forward end, movable locking elements carried by certain of the movable boom sections near their forward ends and being biased toward locking positions, with adjacent movable boom sections, the movable boom sections having locking receivers for said locking elements near their forward and rear ends, and power means on said locking mechanism operable to selectively retract the locking elements from their locking positions to enable the full retraction or full extension selectively of the movable boom sections by the first-named means.

9. In a crane boom as defined in claim 8, and said locking mechanism comprising a support fixed to one side of the boom base section, plural selectively operable power cylinders on said support, said movable locking elements comprising locking pins at stepped elevations on the movable boom sections, and a corresponding number of rocker shafts on the movable boom sections operatively connected with said locking pins and adapted when moved adjacent to said power cylinders to be rotationally operated thereby selectively.

10. In a crane boom as defined in claim 9, and control valves individual to said power cylinders on said support to enable selective individual operation of the power cylinders.

11. In a crane boom as defined in claim 10, and said power cylinders on said support comprising pneumatic cylinders, one portion of said support defining a compressed air manifold, and conduit means connecting said manifold with said control valves and connecting said control valves with said pneumatic cylinders.

12. In a crane boom as defined in claim 11, and said control valves comprising solenoid operated valves.

13. In a crane boom as defined in claim 9, and compression springs engaging said locking pins to bias them toward locking engagement with said movable boom sections, and retracting arms for said locking pins on said rocker shafts movably engaging the locking pins to retract them against the force of said compression springs.

14. In a crane boom as defined in claim 13, and projections formed of low friction material on the forward ends of the locking pins to reduce wear caused by sliding of the bottom walls of movable boom sections across the forward ends of the biased locking pins.

15. In a crane boom as defined in claim 9, and said locking receivers comprising rectangular locking openings formed in the bottom walls of the movable boom sections, and said locking pins being cylindrically formed and being of a size to enter said locking openings and having side notches near their forward ends adapted to receive edges of the rectangular locking openings.

16. A crane boom comprising plural telescoping boom sections which are individually movable relatively and a boom base section which is relatively stationary and in which all of the movable boom sections may nest telescopically, a fixed driving plate on each movable boom section near its rear end and having a guide opening formed therethrough, a single power cylinder anchored within the boom base section and being extensible and retractable longitudinally of the boom to fully extend and fully retract selectively the movable boom sections, cooperative driving means on said single power cylinder and moving therewith and having guided engagement within said guide openings, the cooperative driving means including at least on one side thereof extendable and retractable positive drive elements for said plates biased toward driving engagement therewith, power means on said cooperative driving means to retract said positive drive elements from said plates, and additional selectively operable power means on the boom base section and movable boom sections to releasably lock the latter in fully extended and fully retracted positions.

17. A crane boom as defined in claim 16, and said cooperative driving means comprising a sled structure on said single power cylinder adapted for sliding engagement on the movable boom sections, and said positive drive elements comprising interengaging spring biased drive fingers pivoted to the sled structure and in their biased positions defining a recess for capturing and driving said plates selectively outwardly or inwardly on said boom.

18. A crane boom as defined in claim 17, and said power means on said cooperative driving means comprising at least one power cylinder operatively connected with said fingers to retract the latter to a position on the sled structure inwardly of edge portions of the plates defined by the guide openings.

* * * * *